United States Patent [19]

Hall

[11] 4,398,715

[45] Aug. 16, 1983

[54] BREAKAWAY SAFETY BASE

[76] Inventor: Roger E. Hall, 100 Lakeview Homes, Elizabethtown, Pa. 17022

[21] Appl. No.: 395,279

[22] Filed: Jul. 6, 1982

Related U.S. Application Data

[60] Continuation of Ser. No. 234,618, Feb. 17, 1981, abandoned, which is a division of Ser. No. 18,844, Mar. 8, 1979, Pat. No. 4,266,768, which is a continuation-in-part of Ser. No. 758,638, Jan. 12, 1977, abandoned.

[51] Int. Cl.[3] ..... A63B 71/02

[52] U.S. Cl. ..... 273/25; 273/DIG. 30

[58] Field of Search ..... 273/25, DIG. 30

[56] References Cited

U.S. PATENT DOCUMENTS

| | | | |
|---|---|---|---|
| 357,675 | 2/1887 | Keating | 273/25 |
| 367,889 | 8/1887 | Brown | 273/25 |
| 1,244,044 | 10/1917 | Falconer | 273/25 |
| 2,084,775 | 6/1937 | Orefice | 273/25 |
| 2,695,784 | 11/1954 | Orsatti et al. | 273/25 |
| 2,757,934 | 8/1956 | Dunbar | 273/282 X |
| 2,947,540 | 8/1960 | Henry | 273/25 |
| 3,126,203 | 3/1964 | Bourret | 273/25 |
| 3,181,863 | 5/1965 | Nellermoe | 273/25 |
| 3,198,525 | 8/1965 | Smith | 273/163 A |
| 3,204,958 | 9/1965 | Velasquez | 273/25 |
| 3,273,891 | 9/1966 | Grim | 273/194 A |
| 3,508,747 | 4/1970 | Orsatti | 273/25 |
| 3,819,177 | 6/1974 | Spiro | 272/125 X |
| 3,862,756 | 1/1975 | Selliken | 273/25 |
| 3,895,804 | 7/1975 | Lee | 273/282 X |

FOREIGN PATENT DOCUMENTS

| | | | |
|---|---|---|---|
| 80935 | 9/1959 | Czechoslovakia | 46/25 |

*Primary Examiner*—Anton O. Oechsle

*Attorney, Agent, or Firm*—Kerkam, Stowell, Kondracki & Clarke

[57] ABSTRACT

A breakaway safety base for use in playing baseball where the base is secured to a ground support by resilient deformable interengageable members carried on both the base and support which form a plurality of physical connections securing the base to the support. High-injury potential lateral loading forces on the base shear the connections to free the base for lateral movement across the support.

17 Claims, 18 Drawing Figures

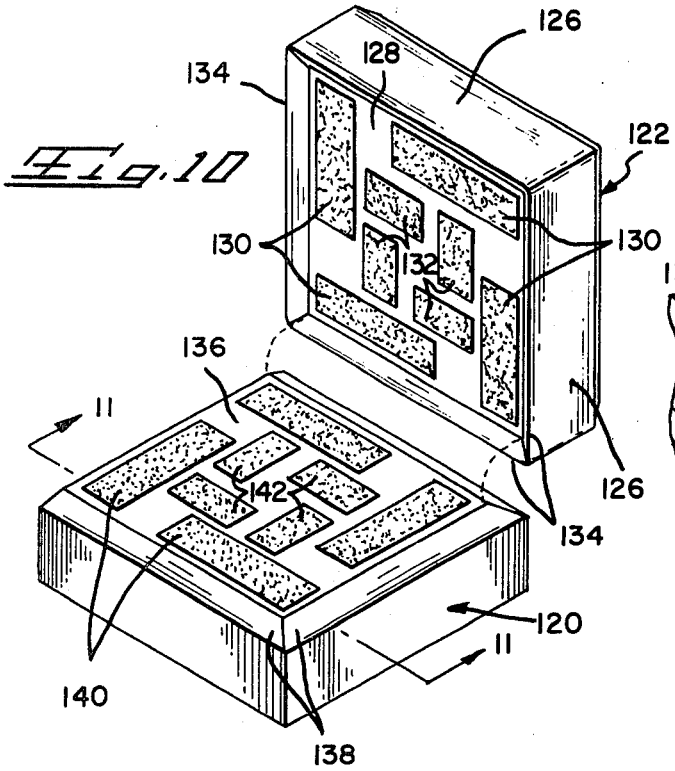
Fig. 10
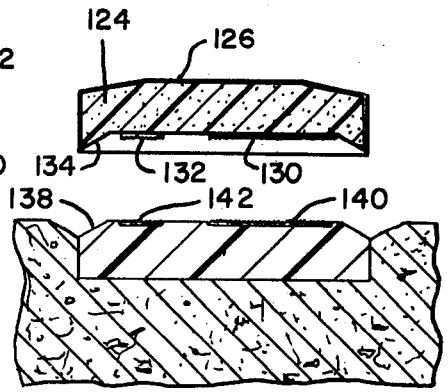
Fig 11
Fig. 12A
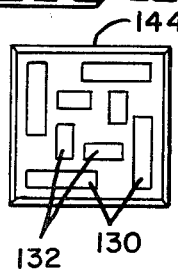
Fig. 12C
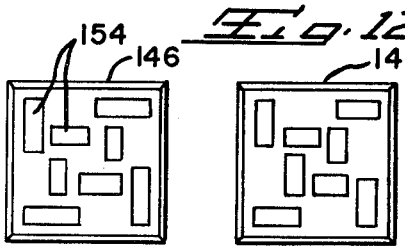
Fig. 12E
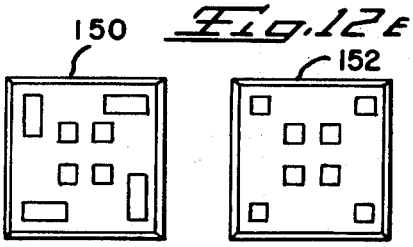
Fig. 12B
Fig. 12D
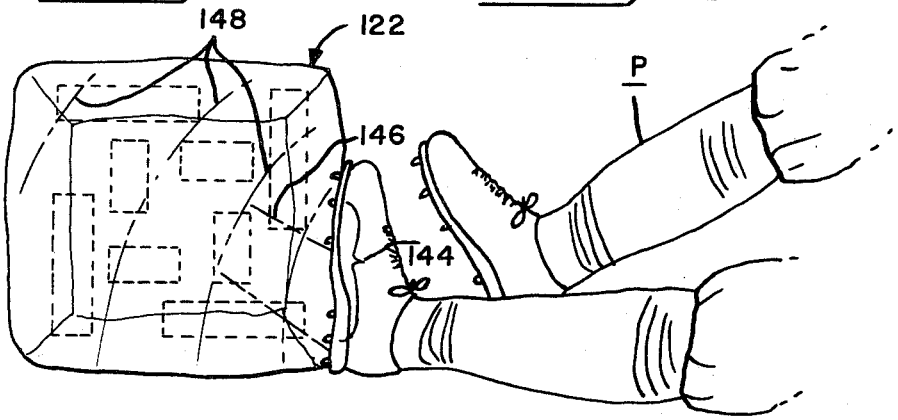
Fig. 13

BREAKAWAY SAFETY BASE

This application is a continuation of application Ser. No. 234,618 filed Feb. 17, 1981 and now abandoned. Ser. No. 234,618 was in turn a division of Ser. No. 018,844 filed Mar. 8, 1979 and now issued as U.S. Pat. No. 4,266,768. Ser. No. 018,844 was in turn a continuation-in-part of Ser. No. 758,638 filed Jan. 12, 1977 and now abandoned.

The invention relates to devices for use in playing the game of baseball and, particularly, to an improved safety base where the base is secured to a fixed support by resilient deformable interengageable elements so that when the base is slid into or subjected to a sufficient lateral force, the base breaks away from the support to reduce the possibility that the player hitting the base is injured. The connection between the base and the support is sufficient to hold the base in place during normal playing of the game but shears and breaks away completely when subjected to a sufficiently high lateral force, no matter in which direction the force is directed against the base.

U.S. Pat. No. 3,862,756 discloses a safety base secured to a support by magnets. U.S. Pat. No. 3,181,863 discloses an indoor base with a floor-engaging surface formed of a resilient rubber to restrict sliding of the base across the floor in U.S. Pat. Nos. 1,244,044, 2,947,540 and 3,204,958 bases are secured to supports during use by specialized spring connections and may be removed when not in use.

The present invention is an improvement over the safety bases disclosed in the prior art because of the specialized type of connection between the base and support. This connection is formed by the interengagement of mounting elements carried on the upper surface of the ground support and on the lower surface of the base. Each of the elements includes a plurality of closely spaced resilient and laterally deformable members so that when the base is placed on the ground support the mounting elements extend past and engage each other to lock together and form a number of physical connections between the base and ground support sufficient to hold the base in place when players hit it with low level lateral forces of the type insufficient to injure the players. When players hit the base and subject it to high-injury potential forces the lateral loading at the connection is sufficient to stress, deform and break the plurality of connections to free the base from the support and prevent injury to the player.

The base and ground support are preferably secured together by woven hook and loop members of the type marketed by Velcro Corporation under the trademark Velcro or by stiffly flexible bristles extending perpendicularly from the base and the support. Both the hook and loop members and the bristle members include interengageable locking surfaces which hold the base against lateral movement until a sufficient lateral force is applied to shear the connections and thereby free the base to prevent player injury. In one embodiment of the invention, the bristles are provided with shoulders facing their respective members so that when interengaged the shoulders lock against each other and improve the connection, while permitting disengagement of the base and support when the bristles are bent by a lateral force directed on the side of the base.

The interengagement area or field of contact between the mounting elements on the base and ground support determines the lateral breakaway force required to shear the connections and free the base from the support. Adult, aggressive players require a higher breakaway force and a larger field of contact between the mounting elements than is required for Little League or Pee Wee team players. Different breakaway forces are easily achieved using a common ground support and different bases. The support has mounting elements arranged on a surface in a pattern and having sufficient total area to provide the desired high breakaway force required for active adult players. Different bases may be placed on the ground support with bases having mounting members with sufficient area to provide a breakaway force appropriate for the particular player. For instance, a ground support intended for use by active adult male players may include eight patches of Velcro material having a total area of 96 square inches. In use with a base having a complementary pattern of Velcro patches totalling 96 square inches in area the breakaway force for the base is 768 pounds. A base intended for use in a girl's softball league requires a lower breakaway force and has Velcro patches having a reduced area engageable with the patches on the ground support to provide the desired lower breakaway force. By selecting the appropriate base the breakaway shear force can be adjusted as desired without the necessity of having to mount different ground supports on the baseball field.

During a baseball game players are likely to contact the base from any given direction. Thus, it is important that a safety breakaway base perform in a reliable manner and breakaway in response to high shear loadings above the breakaway force without regard to the direction of application of the lateral or shear loading force. This uniform breakaway characteristic is provided by distributing a number of pairs of mounting elements across the area of the interface between the base and support. In the case of relatively low breakaway forces the contact areas are further spaced from each other than in the case of bases with relatively high breakaway forces. In the former case, the inherent stiffness of the base insures the desired breakaway action without buckling despite the separation between the individual pairs of mounting elements.

The bases are covered by a canvas material and include a firm and resilient inner body sufficient to retain the shape of the base during play but having a degree of resilience so that the base is not rigid but yields slightly in response to breakaway contact. The bases used with high breakaway forces have a durometer hardness ranging from about 15 to 20 foot pounds so that when the base is slid into by a player and subjected to the high breakaway force the force is transmitted from the point of impact across the base and, as it travels, shears the spaced connections between the base and the ground support. The resiliency of the base, in combination with the spaced connections between the base and the ground support prevent lifting or buckling of the base above the support. Lifting or buckling the base increases the risk of injury to both the player sliding into the base and other players who may contact the base when it is lifted.

Other objects and features of the invention will become apparent as the description proceeds, especially when taken in conjunction with the accompanying drawings illustrating the invention, of which there are two sheets.

In the Drawings:

FIG. 10 is a perspective view of another breakaway safety base according to the invention;

FIG. 11 is a sectional view taken generally along the line 11—11 of FIG. 10 showing the ground support mounted on a playing field with the base above the ground support;

FIGS. 12A, 12B, 12C, 12D and 12E are views of the lower mounting surfaces of bases for use with a common ground support to provide different breakaway forces; and FIG. 13 illustrates the impact of the player against a base of the type shown in FIG. 10.

Figure 1:
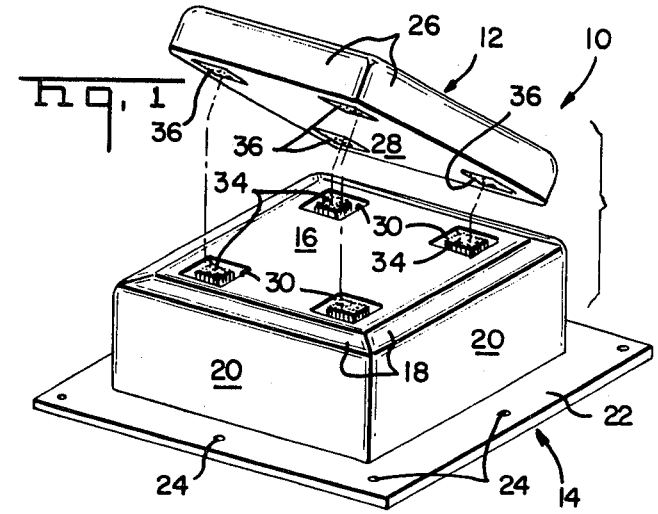
FIG. 1 is a perspective view of a safety base according to the invention.
Figure 2:
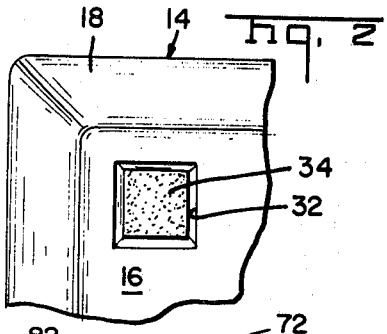
FIG. 2 is an enlarged, partially broken away view of one corner of the support plate.

As illustrated in the drawings, breakaway base 10 includes a base 12 and a support 14. The support is intended to be buried in the soil of the playing field so that the upper or mounting surface 16 thereof is flush with the playing surface, and dirt overlaps the beveled corners 18 between the vertical sidewalls 20 and surface 16. A plate 22 projects outwardly past the sidewalls at the bottom of the support and includes a number of spike receiving holes 24 located at spaced intervals around the circumference of the plate. When buried on the playing field, the support 14 is held in place by the plate 22 and the spikes extend through the plate into the soil beneath the base. These spikes are similar to the spikes illustrated in FIG. 8 of the drawings.

Base 12 may be the conventional type used in playing the game of baseball and includes a top surface (not illustrated), four sidewalls 26 and a lower surface 28 of approximately the same size and shape as the mounting surface 16 of support 14. The support 14 may be made of wood, plastic or other suitable material and the base 12 may be a conventional construction.

Figure 3:
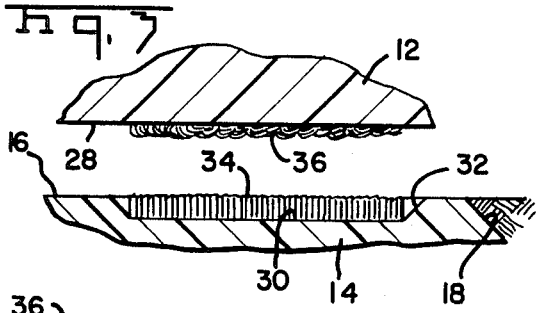
FIG. 3 is a section of view taken through the mounting elements on the base and support plate.
Figure 4:
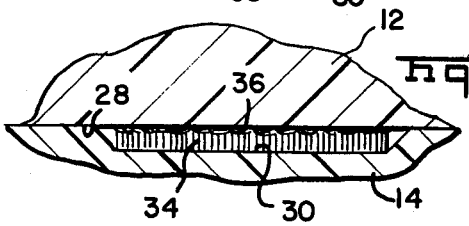
FIG. 4 is like FIG. 3 showing the mounting elements secured to each other.

Four square recesses 30 are provided in surface 16 adjacent to corners thereof. The recesses 30 are provided with beveled edges 32 as illustrated in FIGS. 3 and 4. Retaining elements 34 are secured in recesses 30. Four complementary retaining elements 36 are secured flush on the lower surface 28 of base 12 in the same pattern as elements 34 so that when the base is positioned flush upon the support pairs of elements 34, 36 rest flush upon each other and are physically connected together. The elements 34 project upwardly from the bottom of recesses 30 adjacent the surface 16 so that when the base rests flush on the support the two elements engage each other as shown in FIG. 4 and thereby secure the base on the support.

The connection between the elements is of the breakaway types so that if, during the game of baseball, a player slides or runs into the base 12 and exerts a sufficient lateral force on the base the force will break the physical connection between the pairs of retaining elements and permit the base to slide laterally off of the support to prevent injury to the player. The connections between the pairs of elements are sufficiently strong to hold the base on the support in the desired location on the playing field during the game but are not sufficiently strong to retain the base on the support when subjected to forces likely to injure the players. The feature is particularly important when the game is played by young or inexperienced players who have a greater tendency to be injured by running or sliding into the base.

The lateral forces subjected to the base tends to shear the physical connections between the retaining elements. These connections have a maximum resistance to shear loading so that when the lateral forces exceed this resistance and reaches a breakaway level the connections break or shear apart thereby freeing the base from the ground support.

Figure 5:
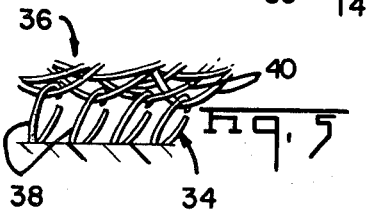
FIG. 5 is an enlarged view of the mounting elements illustrating the engagement between the elements.

In the embodiment of the invention illustrated in FIGS. 1 through 5, the elements used to secure the base to the support are formed of pieces or patches or material manufactured by Velcro U.S.A., Inc. of New York, N.Y., and marketed under the trademark "VELCRO". This material is formed of a mat of woven resilient deformable synthetic fibers with one of each pair of elements having a number of closely spaced slit fiber loops and the other member having a number of closely spaced closed fiber loops. The first element is referred to as a male element, and the second member is referred to as a female element. In the embodiment of FIG. 1 elements 34 are formed of pieces of male Velcro material, and elements 36 are formed of female Velcro material. FIG. 5 illustrates the interengagement between two such members where the hooks 38 of the male elements extend around and hold the loops of the female element, thereby securing the two elements together. Use of the male securing element on the support and the female element on the base has the advantage that when the base is pushed off of the support and slides on the surrounding base path, the smooth female loops do not tend to pick up dirt and mud. Alternatively, it is intended that the female elements may be secured to the support and the male elements may be secured to the base. In this situation, a player sliding who dislodges the base and then slides over the support would be less likely to suffer brush burns when he slides over the smooth female patches than if he slides over the male hooks. Conventionally available Velcro material as a breakaway shear force of approximately eight pounds per square inch contact area.

The recesses 30 in the support surface 16 permit the elements 36 mounted flush on surface 28 of the base to project below the surface 16 supporting the base and thereby fully engage the elements 34 in the recesses. This assures that the crests of the loops and hooks move past each other, positively engage each other and secure the base to the support. When the sides of the base are subjected to a sufficient lateral force the base and loops are moved laterally thereby deforming the loops and hooks and, ultimately, bending the hooks sufficiently that they release from the loops and allow the base to be moved away from the support. When this occurs, the retaining elements 36 on surface 28 are moved past the beveled edges 32 and up onto surface 16. The beveled edges assure that movement of the elements on the base from the recesses 32 to surface 16 is made without injury to the exposed elements such as would occur if the retaining material on the support were positioned in sharp-cornered recesses.

Base 12 can be secured onto the support 14 in and proper orientation, that is with its sidewalls 26 located above support sidewalls 20. Spacing of the complementary pairs of retaining elements assures the desired orientation of the base with respect to the support. Thus, by positioning the support in a desired orientation on the playing field, the desired orientation of the base, when on the support, is assured.

In different situations, different strength connections between the base and support may be desired. Thus, a weaker connection may be desired for young players and a stronger connection may be desired for mature players. This may be accomplished by increasing or decreasing the area of the connections between the mating elements. For example, a single support may be used with a number of bases with each base having retaining elements of different area. The base for use with mature players would have an area of retaining material sufficient to engage the entire area of the retaining material on the support but the base for use with younger players would have an area of retaining material less than the area of retaining material on the support.

Figure 7:
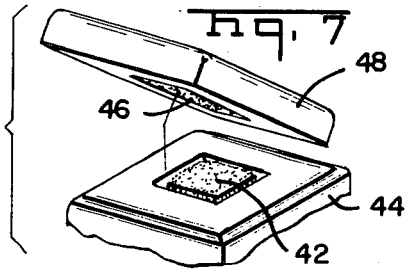
FIG. 7 is a perspective view similar to FIG. 1 of a different embodiment of the invention.

FIG. 7 illustrates an embodiment of the invention in which a square strip retaining element 42 is secured to the mounting surface of support 44 and a complementary square strip retaining element 46 is secured to the lower surface of base 48. In both the embodiments of FIGS. 1 and 7, the base rests flush upon the mounting surface of the support. In this way the base is solidly held on the support. Velcro-type elements may be used.

Figure 6A:
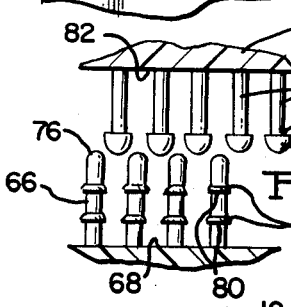
FIGS. 6 and 6A are views similar to FIG. 5 but illustrating different elements.
Figure 6:
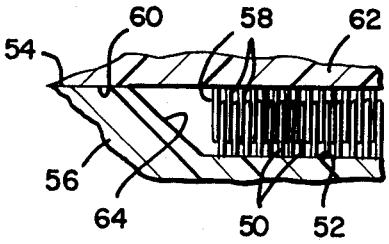

FIG. 6 illustrates an embodiment of the invention like what shown in FIG. 1 but where a bristle type of retaining elements is used to secure the base and support together against lateral shifting. In this case, a number of stiffly flexible bristles 50 is mounted in each recess 52 in the mounting surface 54 of support 56. Likewise, a plurality of complementary stiffly flexible bristles 58 is mounted on the lower surface 60 of the base 62 at locations above each recess 52. Recesses 52 are beveled at edges 64. In this embodiment, the base is placed on the support with the bristles on the base and support interengaged as illustrated. This interengagement prevents lateral shifting of the base except when struck by a player with sufficient lateral force to flex the bristles and allow the base to move to one side with respect to the support. Obviously, the number of bristles provided determines the force required to shift the base across the support and may be adjusted as desired. The recess 52 provides sufficient space between the surfaces on which the bristles are mounted to allow full interengagement of the bristles as shown.

FIG. 6A illustrates another type of retaining elements which may be used to secure the base on the support. In this case, specialized bristles 66 are mounted in recesses 68 in the mounting surface of the support and specialized bristles 70 are mounted on the lower surface of the base 72 above the recesses 68. Bristles 66 and 70 may be molded from a plastic material and, like bristles 50 and 58, are stiffly flexible. The bristles 70 each include enlarged rounded head 72 which extends from the end of the bristle back to a sharp circumferential shoulder 74 extending around each bristle. Bristles 66 have rounded ends 76 and a pair of spaced tapered collars 78 each having a circumferential shoulder 80 facing the surface of the recess 68 in which the bristle is secured. Shoulders 74 likewise face the lower surface 82 of base 72.

When a base carrying bristles 70 is positioned over a support carrying bristles 68 and moved toward the support, the rounded noses 72 and 76 of the bristles guide them past each other so that when the base rests flush upon the support, shoulders 74 extend beyond the shoulders 78 nearest the collars 78 and engage these shoulders to hold the base in place. Lateral forces exerted on the base flex the bristles with respect to each other so that the shoulders are bent out of engagement and permit withdrawal of the bristles. The second collar on bristles 68 assure that the base does not break away immediately when shoulders 78 disengage from the first collars but, rather, that the base is broken away in a gradual manner. The bristles in this embodiment secure the base against being lifted vertically from the support. In both the embodiments of FIGS. 6 and 6A, the bristles on the base slide up the bevel sides of the recesses on the support without injury.

Figure 8:
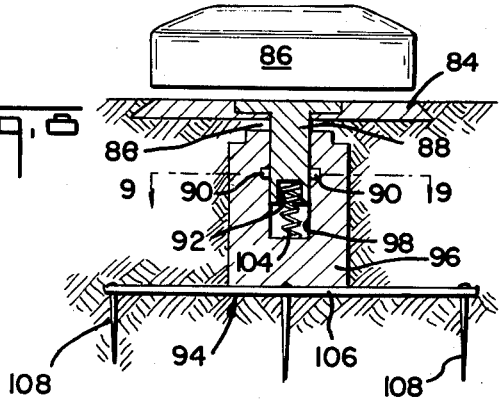
FIG. 8 is a sectional view of a safety base with an improved releasable mounting device for one support.

FIG. 8 illustrates an improved mounting device for the support 84. Base 86 is suitably mounted on the support by retaining materials of the type previously discussed. In this case, the support 84 comprises a plate secured to a ground plug 86, having a shank 88, a pair of diametrically opposed locking ears 90 and a hollow spring recess 92 formed in the lower end of the shank.

Figure 9:
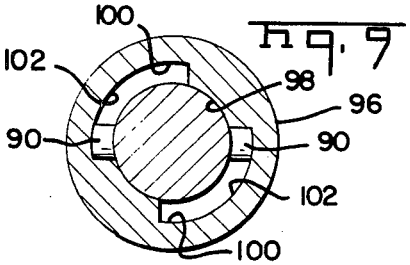
FIG. 9 is a sectional view taken along line 9—9 of FIG. 8.

Ground anchor 94 includes a locking member 96 having a cylindrical bore complimentary with shank 88 extending downwardly from the top thereof with a pair of diametrally opposed slots 100 extending down the sides of the bore from the top of the bore to a pair of lateral slots 102 which extend counter clockwise from the bottom of slots 100 for approximately 90 degrees as illustrated in FIG. 9. A slight recess may be provided in the upper walls of slots 102 at their ends away from slots 100 to aid in retaining the ears 90 of the locking plug in position. A spring 104 in the bottom of bore 98 fits within recess 92 when the shank 88 is fitted within the bore. A mounting plate 106 is secured to the bottom of member 96 and includes openings for a number of ground spikes 108 as illustrated.

The ground anchor for each base is permanently mounted on the playing field at the beginning of the playing season in proper location and angular orientation so that, when the plate 84 is mounted in it, and the base is mounted on the plate, the base is properly positioned. With the anchor in place, the plate and locking plug may be removably secured to the anchor by positioning the shank within the bore with ears within slots 100 and then lowering the plate and ground plug into the anchor to compress the spring and move the ears down to the bottom of slots 100. The plate and plug are then rotated so that the ears are moved along slots 102 and up into the slight recesses provided at the ends of these slots. When in this position, the plate 84 is properly oriented on the playing field and dirt is smoothed over the beveled edges of the plate so that the upper or mounting surface of the plate is flush with the field. The base 86 may then be mounted on the plate as previously described. At the end of the game, the base may be removed from the plate. The loose dirt adjacent to the plate is swept away, and the plate may be rotated and removed from the anchor. A suitable cap or plug is positioned on the top of the ground anchor when the plate is removed to prevent dirt or foreign objects from falling into the bore 98.

FIG. 10 illustrates another embodiment of the invention including a ground support 120 and a base 122. The ground support includes a ground anchor which may be of the type illustrated in FIGS. 8 and 9. The ground support is preferably formed from a plastic or wood and the base 122 is preferably formed from a body 124 of rigid but yieldable polyurethane or latex foam. The body preferably has durometer hardness of from 15 to 20 foot pounds. The body is surrounded by a protective canvas cover 126. The base includes a flat lower mounting surface 128 which carries a number of Velcro material mounting elements or patches 130 and 132 arranged throughout the area of the surface. The patches may be sewn in place on the base. Bevelled edges 134 extend along and below the sides of surface 128.

The ground support 120 includes a flat upper mounting surface 136 with downwardly tapered bevelled edges 138 extending along the sides of the surface. Velcro material mounting elements or patches 140 and 142 are mounted on the support in bevelled recesses on surfaces 136 in the same pattern as mounting elements 130 and 132 are mounted on base surface 128. The recesses in surface 136 are similar to recesses 32 formed in surface 16 and illustrated in FIG. 3.

The base may be placed on the ground in any of four positions with the corners of the base above the corners of the ground support. When base 122 is positioned upon the ground support 120 the bevelled edges 134 sit flush against the bevelled edges 138 and serve to align the base initially on the ground support to assure proper engagement between the mounting element pairs. Also, when the base is in place on the playing field dirt may be swept flush against the sides of the base thereby covering the seam between the base and ground support.

The ground support and base 120 and 122 are intended for use with active aggressive players where a high shear breakaway force is required. In order to assure the high breakaway force the mounting elements carried by the ground support and base completely overlap each other to form the shear-resistance physical connections between the two as described previously. As an example, the side dimensions of the base and ground support may measure 15 inches and the long Velcro mounting elements 130, 140 may measure two inches by eight inches. Each of these elements extends from one corner of its respective flat surface toward an adjacent corner so that when the base is on the ground support in the playing position the paired mounting elements 130, 140 form physical connections between the two extending essentially continuously around the periphery of the assembly. The interior mounting elements 132, 142 may measure two inches by four inches and are arranged in a spaced square pattern substantially filling the area within the center of the mounting and support surfaces. When the base is in the playing position and each mounting element is joined to its corresponding paired element there is a total of 96 square inches of Velcro material-to-Velcro material contact which establishes a static breakaway force of about 768 pounds.

The elements 130 may be considered as resilient and laterally deformable upper peripheral elements, whereas the elements 132 are upper resilient and laterally deformable interior elements. Likewise, the elements 140 may be considered as resilient and laterally deformable lower peripheral elements and the elements 142 are resilient and laterally deformable lower interior elements.

FIG. 13 diagramatically illustrates what is believed happens when a player contacts a base and ground support assembly as shown in FIGS. 10 and 11. The player hits the base 122 at impact area 144 to subject the base to a lateral force acting in the direction of arrow 146. The force momentarily compresses the base at the point of impact to sever the connections between the paired mounting elements adjacent the point of impact 144. This compression wave travels outwardly of the point of impact as indicated by radially increasing lines 148 and, as it sweeps over the ground support, sequentially shears the physical connections betweeen the mounting element pairs to free the base from the ground support. The physical connections holding the base flush on the ground support and the stiffness of the base cooperate to prevent undesired buckling of the base as it is sheared from the support.

During breakaway of the base the corners 134 flex up over the surface 136 and do not interfere with the breakaway of the connections.

A sufficient lateral force displaces the base (or a part of the base) laterally, which, as mentioned above, causes the base corners to flex up. As is apparent from FIG. 11, this flexing up is caused by beveled surface 134 moving laterally relative to beveled surface 138. The beveled surface or edges 138 thus cooperate with the beveled edges 134 to enhance vertical separation between the elements 130 and 132 on the base and the elements 140 and 142 on the ground support. This vertical separation combined with the lateral displacement causes disengagement of the elements.

As the base is broken away from the ground support and the individual paired connections are sheared the base body is compressed laterally. This compression cushioning further decreases the possibility of player injury.

The breakaway forces of a given base is determined by the type of player likely to engage the base. Thus, for active, aggressive players the base requires a high breakaway force and for younger or less active players a lower breakaway force is required. Different bases may be used with a single ground support in order to provide different breakaway forces without the necessity of mounting of a different ground support on the playing field each time different players use the field. The different breakaway force is achieved by use of a different base having mounting elements arranged in a pattern to engage the mounting elements of the standard ground support which may be like ground support 120 of FIG. 10. FIG. 12 illustrates five bases 144, 146, 148, 150 and 152 having progressively reduced area mounting elements and, consequently, progressively reduced breakaway forces when mounted on a ground support 120. Base 144 is similar to base 122 and includes two inch by eight inch and two inch by four inch Velcro mounting elements 130 and 132 having a total area of 96 square inches. These elements rest flush on the ground support mounting elements 140 and 142 to provide a high static breakaway force of about 768 pounds.

Base 146 is provided with peripheral mounting elements 154 measuring two inches by six inches and central mounting elements 156 measuring two inches by four inches for a total area of 80 square inches. When this base is positioned on the ground support 120 there is an interface contact area of 80 square inches and a static breakaway force of about 640 pounds.

In bases 148, 150 and 152 the mounting element areas are reduced, respectively, to 64 square inches, 48 square inches and 32 square inches with corresponding reductions of the static breakaway forces to about 612 pounds, 384 pounds and 256 pounds.

Reduction of the contact area of the mounting element pairs spaces these pairs further apart on the interface surface between the base and ground support. The relatively low breakaway forces required to breakaway these bases from the ground support is insufficient to buckle the base above the ground support.

While I have illustrated and described a preferred embodiment of my invention, it is understood that this is capable of modification, and I therefore do not wish to be limited to the precise details set forth, but desire to avail my self of such changes and alterations as fall within the purview of the following claims.

What I claim is my invention:

1. A base assembly comprising:

(a) a base member having a lower mounting surface with beveled edges extending out and downwardly, and (b) a resilient and laterally deformable upper element secured to said lower mounting surface and including a first engagement surface, (c) a lower ground support having an upper mounting surface with downwardly beveled edges, and (d) a resilient and laterally deformable lower element secured to said upper mounting surface and including an engagement surface, and wherein said base member is secured to said lower ground support with the engagement surface of said upper element engaged to said engagement surface of said lower element and with said beveled edges of said base member resting on said beveled edges of said lower ground support, said base member being held to said lower ground support when said base member is subject to low non-injury potential lateral force, but the engagement being severable when said base member is subject to high injury potential lateral force, said beveled edges of said base cooperating with said beveled edges of said lower ground support to enhance vertical separation between said upper element and said lower element when said base is subject to lateral force.

2. The base assembly of claim 1 wherein said upper element is a male element or a female element and is adapted to interlock with an element of the opposite sex.

3. The base assembly of claim 1 wherein the engagement surface of said upper element is a member of the group comprising:

(i) fiber loops, and (ii) fiber loop-engaging hooks, and is adapted to interlock with the other member of said group.

4. The base assembly of claim 1 wherein the engagement surface of said upper element and the engagement surface of said lower element each comprise a mat of woven synthetic fibers.

5. The base assembly of claim 4 wherein said upper element is one of a plurality of resilient and laterally deformable upper elements secured to said lower mounting surface, each upper element including an engagement surface, and wherein said lower element is one of a plurality of resilient and laterally deformable lower elements secured to said upper mounting surface, each lower element including an engagement surface, and wherein the engagement surface of each upper element is interlocked to the engagement surface of a cooperating lower element and said base member is adapted to sever the engagement between some of said upper elements and said lower elements closest to a point of applied lateral force while the remainder of said upper elements and lower elements hold said base member to said ground support unless a total shear breakaway force is exceeded, and wherein the engagement surface of each upper element is a member of said group and its cooperating lower element has an engagement surface which is the other member of said group.

6. The base assembly of claim 5 wherein said upper elements include four peripheral elements and four interior elements.

7. A base assembly comprising:

(a) a base member having a lower mounting surface with beveled edges extending out and downwardly, (b) a resilient and laterally deformable upper element secured to said lower mounting surface and having an engagement surface, (c) a lower ground support having an upper mounting surface with downwardly beveled edges, and (d) a resilient and laterally deformable lower element secured to said upper mounting surface and including an engagement surface, and wherein said base member is secured to said lower ground support with the engagement surface of said upper element interlocked to the engagement surface of said lower element and with said beveled edges of said base member resting on said beveled edges of said lower ground support, said base member held to said lower ground support when said base member is subject to low non-injury potential lateral force, but the engagement is severable when said base member is subject to high injury potential lateral force, and wherein said upper element is a member of the group comprising:

(i) a male element, and (ii) a female element, and said lower element is the other member of said group, and said beveled edges of said base cooperate with said beveled edges of said lower ground support to enhance vertical separation between said upper element and said lower element when said base is subject to lateral force.

8. The base assembly of claim 7 wherein said upper element and said lower element each comprise a mat of woven synthetic fiber.

9. The base assembly of claim 7 wherein said upper element is one of a plurality of resilient and laterally deformable upper elements secured to said lower mounting surface, each upper element including an engagement surface, and wherein said lower element is one of a plurality of resilient and laterally deformable lower elements secured to said upper mounting surface, each lower element including an engagement surface, and wherein the engagement surface of each upper element is interlocked to the engagement surface of a cooperating lower element and said first member is adapted to sever the engagement between some of said upper elements and said lower elements closest to a point of applied lateral force while the remainder of said upper elements and lower elements hold said base member to said ground support unless a total shear breakaway force is exceeded, and wherein each upper element is a member of said last-mentioned group and its cooperating lower element is the other member of said last-mentioned group.

10. The base assembly of claim 9 wherein said upper elements include four peripheral elements and four interior elements, and said lower elements include four peripheral elements and four interior elements.

11. A base assembly comprising a ground support having an upper mounting surface and a deformable and severable base member disposed thereon, said ground support having beveled peripheral edges downwardly extending from said upper mounting surface, said base member having a recessed lower mounting surface and downwardly and outwardly extending beveled edges, said base member disposed on said ground support such that said beveled edges of said base member rest on said beveled edges of said ground support, and lower means on said ground support for severably holding to an upper means on said base member and to allow separation of said base member from said ground support when said base member is subject to a lateral high injury potential force and wherein said upper means for holding comprises at least one resilient and laterally deformable upper element, and wherein said lower means for holding comprises at least one resilient and laterally deformable lower element interlocked to said upper element, and said beveled edges of said lower ground support cooperate with said beveled edges of said base to enhance vertical separation between said upper element and said lower element when said base is subject to lateral force.

12. The base assembly of claim 11 wherein said upper means for holding comprises a plurality of resilient and laterally deformable upper elements, and wherein said lower means for holding comprises a plurality of resilient and laterally deformable lower elements, and wherein each one of said upper elements is interlocked to a corresponding one of said lower elements.

13. The base assembly of claim 12 wherein each of said upper elements is a member of the group comprising:

(i) a female element having an engagement surface of fiber loops, and (ii) a male element having an engagement surface of fiber loop-engaging hooks, and its cooperating lower element is the other member of said group.

14. The base assembly of claim 13 wherein said upper elements include four peripheral upper elements and four interior upper elements, and said lower elements include four peripheral lower elements and four interior lower elements.

15. The base assembly of claim 14 wherein each of said four peripheral upper elements is longer than each of said four interior upper elements, and each of said four peripheral lower elements is longer than each of said four interior lower elements.

16. The base assembly of claim 15 wherein the longest side of some of said four peripheral lower elements is perpendicular to the longest side of other of said four peripheral lower elements.

17. The base assembly of claim 16 wherein the surface area of said upper mounting surface covered by said lower elements is less than the remainder of surface area of said upper mounting surface.

* * * * *